US010076825B2

(12) United States Patent
Takenouchi

(10) Patent No.: US 10,076,825 B2
(45) Date of Patent: Sep. 18, 2018

(54) METHOD OF GRINDING WAFER

(71) Applicant: DISCO CORPORATION, Tokyo (JP)

(72) Inventor: Kenji Takenouchi, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 188 days.

(21) Appl. No.: 15/049,375

(22) Filed: Feb. 22, 2016

(65) Prior Publication Data

US 2016/0256981 A1 Sep. 8, 2016

(30) Foreign Application Priority Data

Mar. 3, 2015 (JP) ..... 2015-041175

(51) Int. Cl.

| | |
|---|---|
| ***B24D 7/06*** | (2006.01) |
| ***B24B 7/00*** | (2006.01) |
| ***B24B 7/24*** | (2006.01) |
| ***B24B 7/22*** | (2006.01) |

(52) U.S. Cl.

CPC ..... *B24D 7/06* (2013.01); *B24B 7/00* (2013.01); *B24B 7/228* (2013.01); *B24B 7/241* (2013.01)

(58) Field of Classification Search

CPC ..... B24B 7/228; B24B 7/24; B24B 7/241; B24B 41/053; B24D 7/06; B24D 7/063; B24D 7/18

See application file for complete search history.

(56) References Cited

U.S. PATENT DOCUMENTS

| | | | | |
|---|---|---|---|---|
| 6,364,744 | B1 * | 4/2002 | Merchant | B24B 37/04 257/E21.304 |
| 6,435,947 | B2 * | 8/2002 | Mueller | B24B 37/24 257/E21.304 |
| 6,875,088 | B2 * | 4/2005 | Matsui | B24B 37/24 257/E21.304 |
| 7,029,374 | B2 * | 4/2006 | Chen | B08B 7/0035 134/1.3 |
| 7,071,108 | B2 * | 7/2006 | Matsui | C09G 1/02 257/E21.304 |
| 2004/0072505 | A1 * | 4/2004 | Matsui | B24B 37/24 451/41 |
| 2007/0020887 | A1 * | 1/2007 | Sekiya | B24B 7/228 438/459 |
| 2007/0212986 | A1 * | 9/2007 | Priewasser | B24B 7/228 451/41 |
| 2010/0087125 | A1 * | 4/2010 | Ohnishi | B24B 1/04 451/67 |
| 2013/0133209 | A1 * | 5/2013 | Sueda | B26B 21/60 30/350 |

FOREIGN PATENT DOCUMENTS

| | | |
|---|---|---|
| JP | 2001-284303 | 10/2001 |

* cited by examiner

*Primary Examiner* — Timothy V Eley
(74) *Attorney, Agent, or Firm* — Greer Burns & Crain Ltd.

(57) ABSTRACT

Disclosed herein is a grinding wheel including an annular wheel base and a plurality of grinding stones fixed to an outer circumferential portion of the lower end of the annular wheel base. Each of the grinding stones is made of a mixture of abrasive grains and photocatalytic particles which are held together by a binder. The abrasive grains are diamond abrasive grains, and the photocatalytic particles are titanium oxide ($TiO_2$) particles.

1 Claim, 7 Drawing Sheets

METHOD OF GRINDING WAFER

BACKGROUND OF THE INVENTION

1. Field of the Invention

The present invention relates to a grinding wheel for grinding a wafer, a grinding apparatus having a grinding wheel, and a method of grinding a wafer.

2. Description of the Related Art

Wafers on which devices such as ICs, LSI circuits, LEDs, SAW devices, or the like have been separated by projected dicing lines and formed on their surfaces are ground on their reverse sides to a predetermined thickness by a grinding apparatus having a rotatable grinding wheel, and then divided by a dividing apparatus such as a dicing apparatus, a laser machining apparatus, or the like into individual devices for use in various electronic devices, etc.

The grinding apparatus generally includes a chuck table for holding a wafer thereon, grinding means having a rotatable grinding wheel which includes an annular array of grinding stones for grinding the wafer held on the chuck table, grinding water supply means for supplying grinding water to a region where the wafer is ground, and grinding feed means for moving the grinding means toward and away from the chuck table. The grinding apparatus is capable of grinding the wafer highly accurately to a desired thickness (see, for example, Japanese Patent Laid-Open No. 2001-284303).

SUMMARY OF THE INVENTION

If a wafer to be ground is made of a material that is difficult to machine, e.g., gallium nitride (GaN), silicon carbide (SiC), or gallium arsenide (GaAs), then the grinding capability of the grinding wheel tends to be lowered, resulting in a reduction in the productivity. When a wafer made of metal or a wafer with metal electrodes partly exposed on the reverse side thereof is ground, difficulty arises in grinding the wafer due to the ductility of metal.

Therefore, it is an object of the present invention to provide a grinding wheel which is capable of smoothly grinding a wafer made of a material that is difficult to machine or a wafer including metal, and a method of grinding such a wafer using such a grinding wheel.

In accordance with an aspect of the present invention, there is provided a grinding wheel including an annular wheel base having a lower end, and a plurality of grinding stones fixed to an outer circumferential portion of the lower end of the annular wheel base, each of the grinding stones being made of a mixture of abrasive grains and photocatalytic particles which are held together by a binder.

Preferably, the abrasive grains include diamond abrasive grains, and the photocatalytic particles include titanium oxide ($TiO_2$) particles.

In accordance with another aspect of the present invention, there is provided a method of grinding a wafer including the steps of holding a wafer on a chuck table, grinding the wafer by pressing a plurality of grinding stones, each made of a mixture of abrasive grains and photocatalytic particles which are held together by a binder, against the wafer held on the chuck table and rotating the grinding stones and the chuck table while supplying grinding water to the grinding stones and the chuck table, and applying light for exciting the photocatalytic particles to the grinding stones to give oxidizing power based on hydroxyl radicals to the supplied grinding water while the wafer is being ground.

In accordance with a further aspect of the present invention, there is provided a grinding apparatus including a chuck table for holding a wafer thereon under suction, a grinding unit including a spindle, a wheel mount fixed to a lower end of the spindle, and a grinding wheel removably mounted on the wheel mount, the grinding wheel having an annular wheel base and a plurality of grinding stones fixed to an outer circumferential portion of a lower end of the annular wheel base, grinding water supply means for supplying grinding water to the grinding stones, and light applying means for applying light for exciting photocatalytic particles to the grinding stones of the grinding wheel to give oxidizing power based on hydroxyl radicals to the supplied grinding water.

The grinding wheel according to the present invention includes the grinding stones each made of a mixture of abrasive grains and photocatalytic particles which are held together by a binder, and the annular wheel base with a free end to which the grinding stones are fixed in an annular pattern. When the grinding wheel according to the present invention is used to grind a wafer made of a material which is difficult to machine, such as GaN, SiC, GaAs, or the like, light such as a ultraviolet radiation or the like is applied to the grinding stones to excite the photocatalytic particles, and grinding water supplied to the grinding stones and the excited photocatalytic particles in the grinding stones are brought into contact with each other, giving strong oxidizing power based on hydroxyl radicals to the grinding water supplied to the grinding stones. Since the wafer is ground while the surface thereof which is being ground is oxidized and embrittled by the strong oxidizing power, the wafer can smoothly be ground. Even in the case where the grinding wheel is used to grind a wafer made of metal or a wafer with metal electrodes partly exposed on the reverse side thereof, the wafer is ground while the metal thereof is being oxidized and embrittled by the strong oxidizing power of hydroxyl radicals. Therefore, the wafer can smoothly be ground.

The abrasive grains should preferably include diamond abrasive grains, and the photocatalytic particles should preferably include titanium oxide ($TiO_2$) particles. When an ultraviolet radiation is applied to the grinding stones to excite the titanium oxide particles, and grinding water supplied to the grinding stones and the excited titanium oxide particles are brought into contact with each other, strong oxidizing power based on hydroxyl radicals is given to the grinding water supplied to the grinding stones.

In the method of machining a wafer according to the present invention, grinding water is supplied to the grinding stones that are positioned in a region to be ground of the wafer, and light for exciting the photocatalytic particles is applied to the grinding stones to bring into contact with each other and to give strong oxidizing power based on hydroxyl radicals to the supplied grinding water during the step of grinding the wafer with the grinding wheel. Therefore, even if a wafer made of a material which is difficult to machine, such as GaN, GaAs, or the like is to be ground, since the surface to be ground of the wafer is oxidized and embrittled by the strong oxidizing power of the hydroxyl radicals, the wafer can smoothly be ground. Even in the case where a wafer made of metal or a wafer with metal electrodes partly exposed on the reverse side thereof is to be ground, since the metal thereof is oxidized and embrittled by the strong oxidizing power of hydroxyl radicals, the wafer can smoothly be ground.

The grinding apparatus according to the present invention includes at least grinding means having the grinding wheel, grinding water supply means for supplying grinding water to grinding stones of the grinding wheel positioned in a region to be ground of a wafer, and light applying means for applying light for exciting photocatalytic particles to the grinding stones of the grinding wheel to give oxidizing power based on hydroxyl radicals to the supplied grinding water. When the grinding apparatus grinds the wafer, light for exciting photocatalytic particles is applied to the grinding stones, and the grinding water supplied to the grinding stones and the excited photocatalytic particles are brought into contact with each other, giving strong oxidizing power based on hydroxyl radicals to the grinding water supplied to the grinding stones. Therefore, even if a wafer made of a material which is difficult to machine, such as GaN, GaAs, or the like is to be ground, since the surface to be ground of the wafer is oxidized and embrittled by the strong oxidizing power of the generated hydroxyl radicals, the grinding apparatus can smoothly grind the wafer. Even in the case where a wafer made of metal or a wafer with metal electrodes partly exposed on the reverse side thereof is to be ground, since the metal thereof is oxidized and embrittled by the strong oxidizing power of hydroxyl radicals, the grinding apparatus can smoothly grind wafer.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
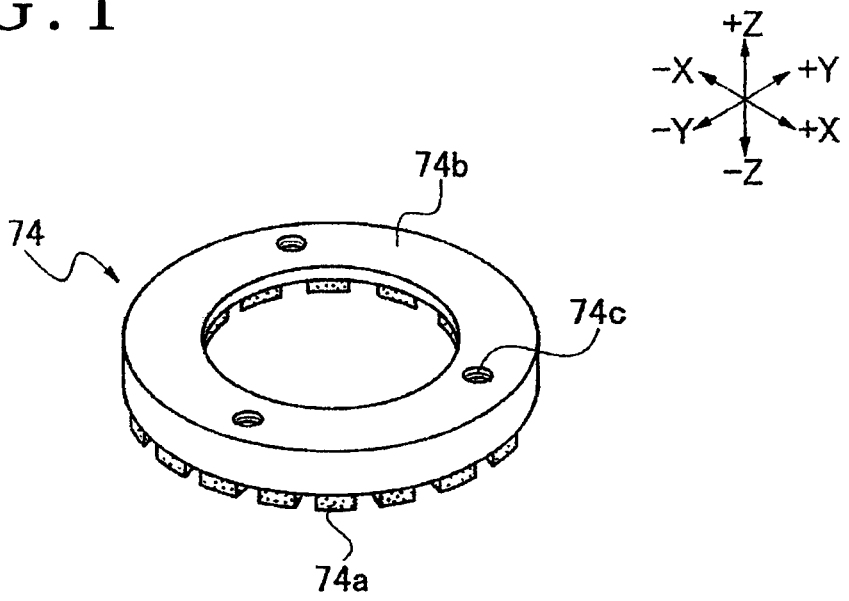
FIG. 1 is a perspective view of a grinding wheel.
Figure 2:
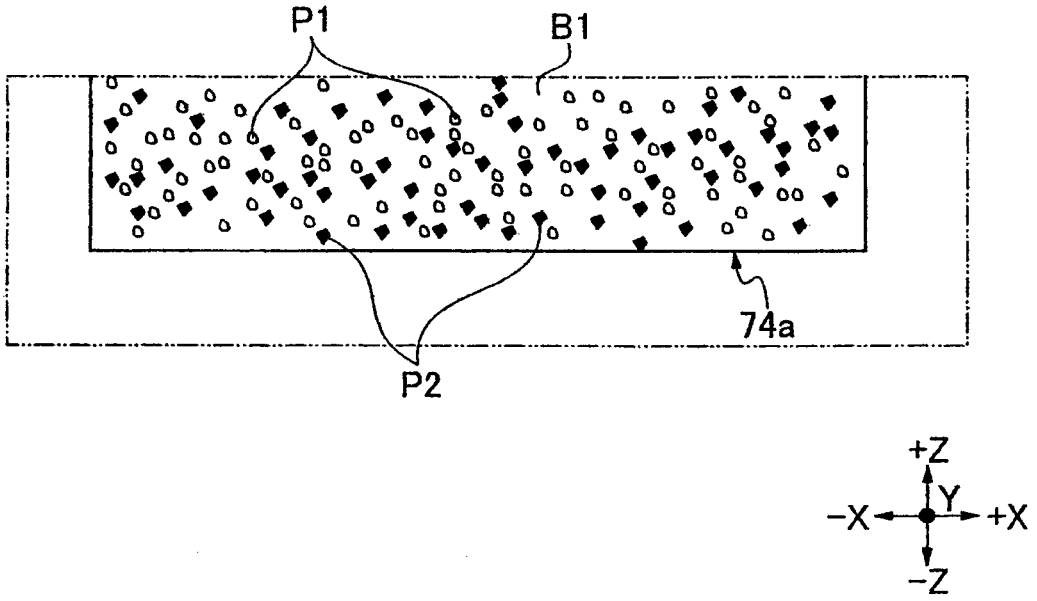
FIG. 2 is a front elevational view, partly on enlarged scale, a grinding stone included in the grinding wheel.

As shown in FIG. 1, a grinding wheel 74 includes an annular wheel base 74*b* and a plurality of grinding stones 74*a*, each substantially in the form of a rectangular parallelepiped, disposed in an annular pattern on and fixed to an outer circumferential portion of the bottom surface (lower free end) of the wheel base 74*b*. The wheel base 74*b* has screw holes 74*c* defined in the upper surface thereof. As shown in FIG. 2, each of the grinding stones 74*a* is made of a mixture of diamond abrasive grains P1 and titanium oxide ($TiO_2$) particles P2, which serve as photocatalytic particles, that are held together by a phenolic resin binder B1 and molded to shape. The grinding stones 74*a* may be replaced with an integral annular grinding stone.

The grinding wheel 74 is manufactured, for example, as follows: First, phenolic resin by a weight ratio of 100, which serves as phenolic resin binder B1, is mixed with diamond abrasive grains P1, each having a diameter of about 10 μm, by a weight ratio of 30, and the mixture is further mixed with titanium oxide particles P2, each having a diameter of about 10 μm, by a weight ratio of 40. They are stirred and mixed together. The mixture is then heated at a temperature of about 160° C., and pressed and molded to a predetermined shape for 10 minutes to 20 minutes. Then, the molded mass is sintered for several hours at a temperature ranging from 180° C. to 200° C., producing a grinding stone 74*a*. A plurality of grinding stones 74*a* thus produced are arranged in an annular array and fixed to the bottom surface of the wheel base 74*b*, producing a grinding wheel 74. The weight ratios of the phenolic resin binder B1, the diamond abrasive grains P1, and the titanium oxide particles P2 may be changed appropriately depending on the kind of the titanium oxide particles P2, etc.

Figure 3:
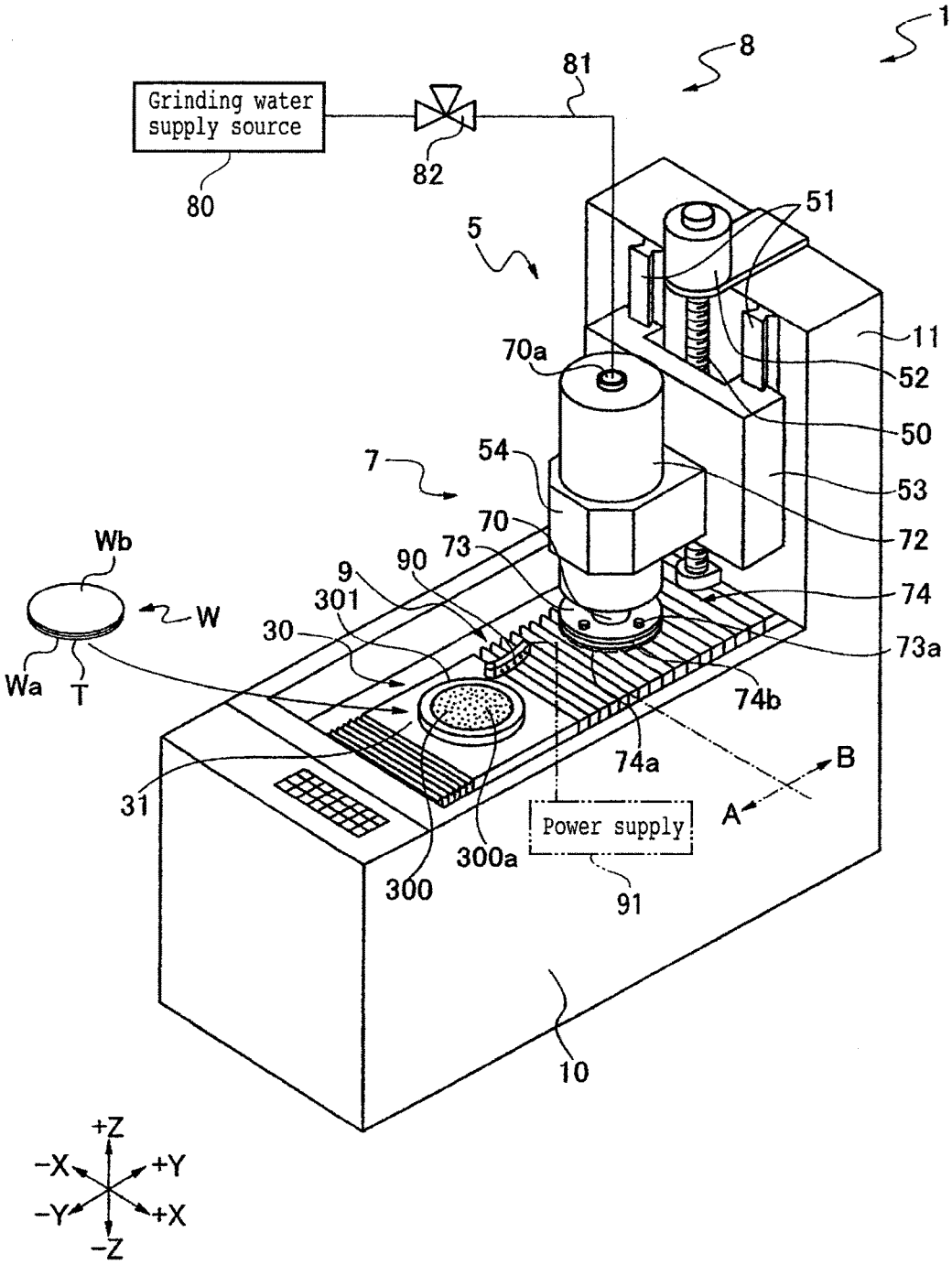
FIG. 3 is a perspective view of a grinding apparatus.
Figure 5:
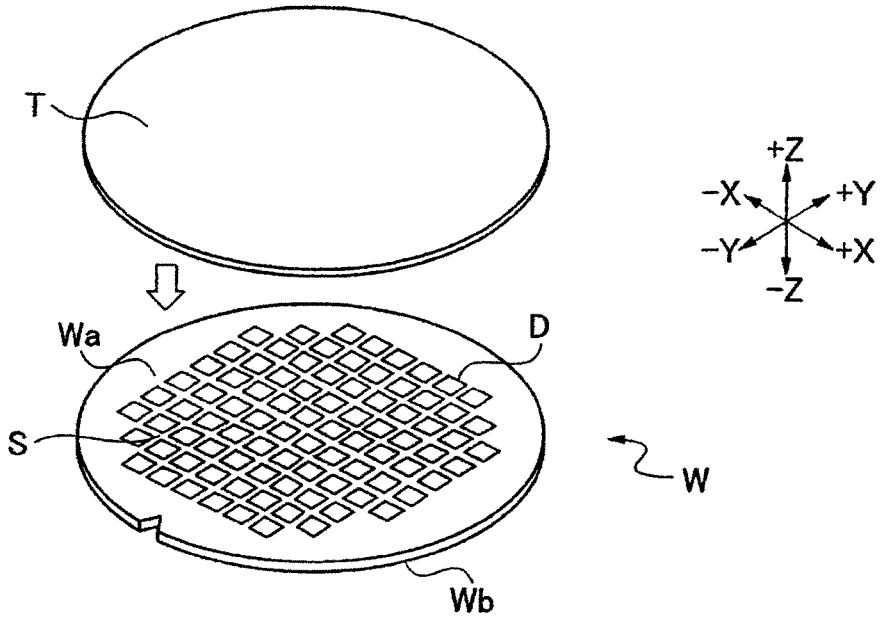
FIG. 5 is a perspective view showing the manner in which a protective tape is applied to the surface of a wafer.

A wafer W shown in FIG. 3 is a semiconductor wafer of SiC, for example. As shown in FIG. 5, a number of devices D are formed in grid-like regions separated by streets S on a surface Wa of the wafer W. A reverse side Wb, for example, of the wafer W is ground by the grinding wheel 74. The shape and the kind of the wafer W are not limitative, but may be changed appropriately in relation to the grinding wheel 74. The wafer W may include a wafer made of a material which is difficult to machine, such as GaAs, GaN, or the like, and a wafer made of metal or a wafer with metal electrodes partly exposed on the reverse side thereof.

As shown in FIG. 3, a grinding apparatus 1 includes at least a chuck table 30 for holding the wafer W thereon, grinding means 7 for grinding the wafer W that is held on the chuck table 30 with the grinding wheel 74 shown in FIG. 1 which is mounted on a wheel mount 73 that is coupled to the lower tip end of a rotational shaft (spindle) 70, grinding water supply means 8 for supplying grinding water to the grinding stones 74*a* positioned on a region to be ground of the wafer W, and light applying means 9 for applying light for exciting the photocatalytic particles to the grinding stones 74*a* of the grinding wheel 74 thereby to give oxidizing power based on hydroxyl radicals to the supplied grinding water. The grinding apparatus 1 also includes a base 10 on which the above components are supported, and has an area on a front portion of the base 10 which is referred to as a loading/unloading area A where the wafer W is loaded on and unloaded from the chuck table 30, and an area on a rear portion of the base 10 which is referred to as a grinding area B where the wafer W is ground by the grinding means 7.

The chuck table 30 has a circular outer shape, for example, and includes an attraction pad 300 for attracting the wafer W and a frame 301 supporting the attraction pad 300. The attraction pad 300 is held in fluid communication with a suction source, not shown, and has a holding surface 300*a* that is exposed in the attraction pad 300 for holding the wafer W under suction. The chuck table 30 is surrounded by a peripheral cover 31, and is rotatably supported by rotating means, not shown. The chuck table 30 is reciprocally movable along a Y-axis between the loading/unloading area A and the grinding area B by an Y-axis feeder, not shown, disposed below the cover 31.

A column 11 extends upwardly from the base 10 in the grinding area B, and grinding feed means 5 is disposed on a side surface of the column 11. The grinding feed means 5 includes a ball screw 50 having a vertical axis extending along a Z-axis, a pair of guide rails 51 extending parallel to an disposed one on each side of the ball screw 50, a motor 52 coupled to the upper end of the ball screw 50 for rotating the ball screw 50 about its own axis, a vertically movable plate 53 having an internal nut threaded over the ball screw 50 and a pair of side legs held in sliding contact with the respective guide rails 51, and a holder 54 mounted on the vertically movable plate 53 and holding the grinding means 7. When the motor 52 rotates the ball screw 50 about its own axis, the vertically movable plate 53 is reciprocally moved along the Z-axis while being guided by the guide rails 51, feeding the grinding means 7 held by the holder 54 along the Z-axis.

The grinding means (grinding unit) 7 shown in FIG. 3 includes the spindle 70 whose axis extends along the Z-axis, a motor 72 for rotating the spindle 70 about its own axis, the wheel mount 73 coupled to the lower tip end of the spindle 70, and the grinding wheel 74 removably mounted on the lower surface of the wheel mount 73. The grinding wheel 74 is mounted on the wheel mount 73 by screws 73*a* extending through respective holes defined in the wheel mount 73 and threaded in the respective screw holes 74*c* shown in FIG. 1 which are defined in the upper surface of the wheel base 74*b* of the grinding wheel 74. As shown in FIG. 3, the spindle 70 has a passageway 70*a* defined centrally therein along its axis for passing the grinding water therethrough. The passageway 70*a* extends through the wheel mount 73 and is open downwardly at the grinding wheel 74, and is held in fluid communication with a pipe 81 that is connected to a grinding water supply source 80.

The grinding water supply means 8 shown in FIG. 3 includes, for example, the grinding water supply source 80 that serves as a water source, the pipe 81 connected to the grinding water supply source 80 and held in fluid communication with the passageway 70*a*, and a flow rate regulating valve 82 provided at an arbitrary position in the pipe 81 for regulating the flow rate of the grinding water.

Figure 9:
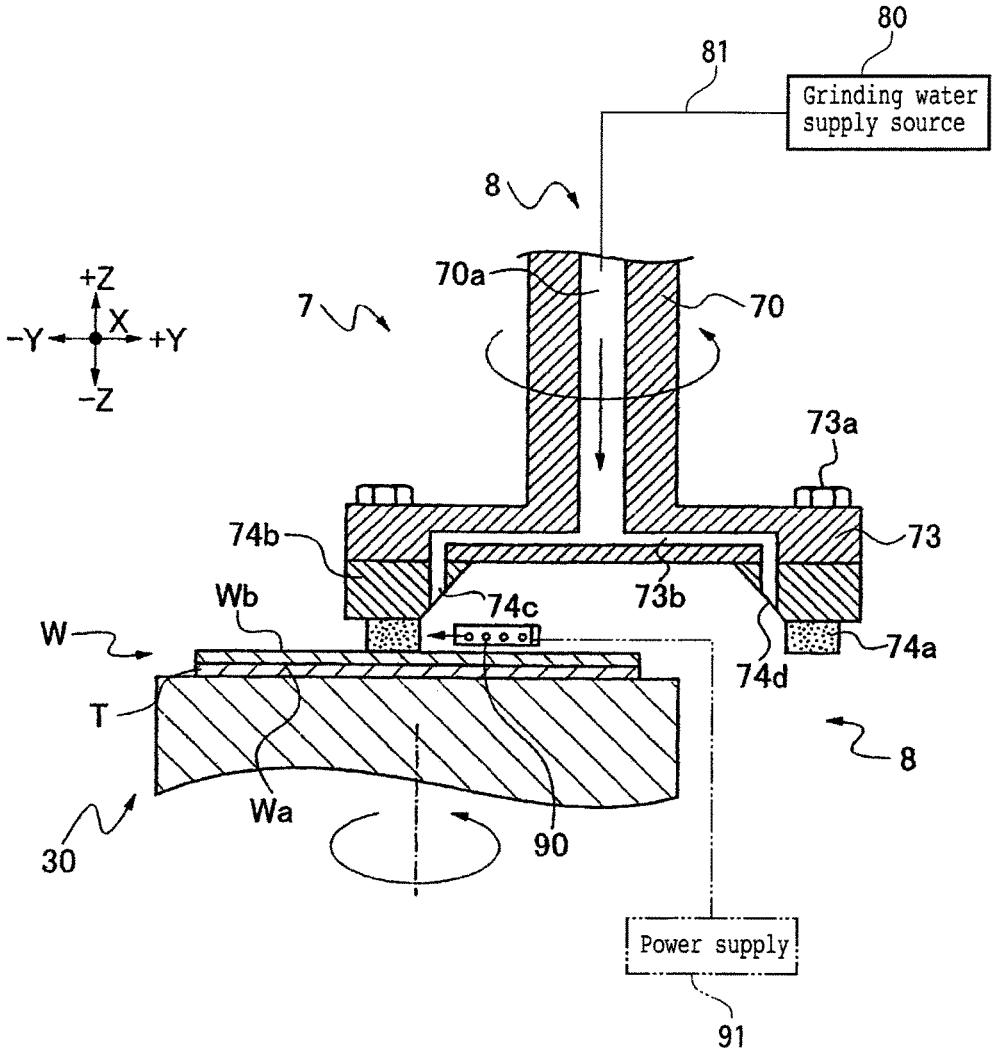
FIG. 9 is an end view showing the manner in which the grinding wheel is grinding the wafer held on the chuck table in the grinding step.

As shown in FIG. 3, the light applying means 9 is included in the grinding apparatus 1 separately from the grinding wheel 74, for example. The light applying means 9 includes an ultraviolet emission lamp, which is substantially arcuate in shape, for emitting an ultraviolet radiation having a wavelength in the range from about 280 nm to 380 nm from light emission ports 90. The light applying means 9 is electrically connected to a power supply 91. As shown in FIG. 9, in a grinding step of grinding the wafer W with the grinding wheel 74, the light applying means 9 is positioned radially inwardly of the grinding stones 74*a* arranged annularly on the bottom surface (free end) of the wheel base 74*b*, with the light emission ports 90 facing the inner circumferential surfaces of the grinding stones 74*a*, and applies the ultraviolet radiation for exciting the titanium oxide particles P2 in the grinding stones 74*a* from the light emission ports 90. Depending on the kind of the titanium oxide particles P2, the light applying means 9 may not be limited to the ultraviolet emission lamp for emitting the ultraviolet radiation. If the titanium oxide particles P2 are nitrogen-doped titanium oxide particles, i.e., titanium oxide particles P2 doped with nitrogen for developing a photocatalytic activity when irradiated with a visible light ray, for example, then the light applying means 9 may include a xenon lamp, a fluorescent lamp, or the like for emitting a visible light ray having a wavelength in the range from about 400 nm to 740 nm. The light applying means 9 is not limited to the substantially arcuate shape, but may be of an annular shape, for example. In the grinding step of grinding the wafer W with the grinding wheel 74, the light applying means 9 may be positioned radially outwardly of the grinding stones 74*a* arranged annularly on the bottom surface (free end) of the wheel base 74*b*, and should preferably be positioned such that the ultraviolet radiation emitted from the light emission ports 90 will be applied directly to the grinding stones 74*a* without being scattered.

Figure 4:
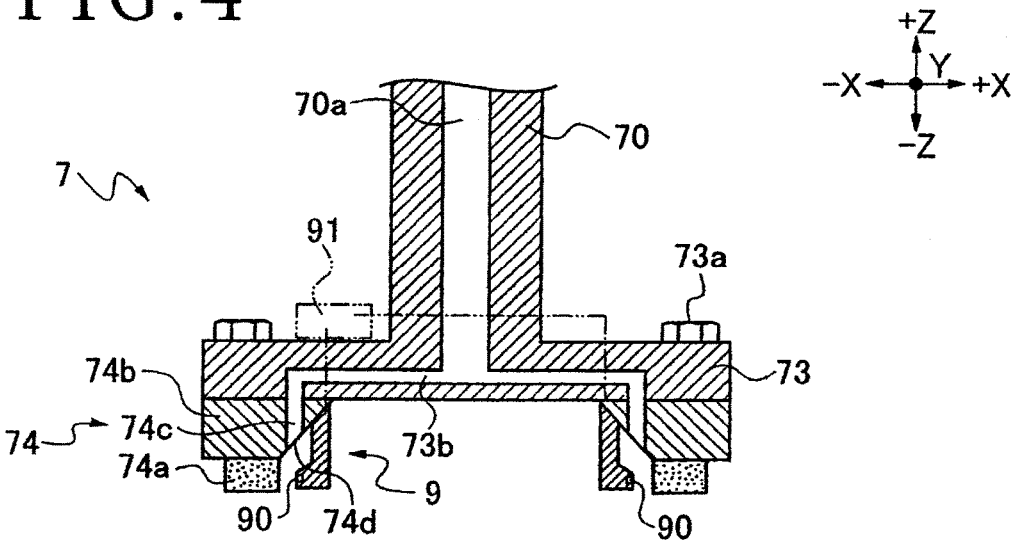
FIG. 4 is an end view showing by way of example a grinding wheel integrally combined with light applying means.

As shown in FIG. 4, the light applying means 9 may be provided in the grinding apparatus 1 in integral combination with the grinding wheel 74. According to the modification shown in FIG. 4, the light applying means 9 that is provided in the grinding apparatus 1 in integral combination with the grinding wheel 74 includes an annular ultraviolet emission lamp for emitting an ultraviolet radiation having a wavelength in the range from about 280 nm to 380 nm from light emission ports 90, for example. The light applying means 9 is disposed radially inwardly of the grinding stones 74*a* arranged annularly on the bottom surface of the wheel base 74*b*, with the light emission ports 90 facing the inner circumferential surfaces of the grinding stones 74*a*, and is electrically connected to the power supply 91 disposed on the wheel mount 73. The wheel mount 73 has a mount passageway 73*b* defined therein which is held in fluid communication with the passageway 70*a* defined in the spindle 70. The wheel base 74*b* of the grinding wheel 74 has a wheel passageway 74*c* defined therein which is held in fluid communication with the mount passageway 73*b* and is open at an opening 74*d* thereof in a lower portion of the wheel base 74*b*. The opening 74*d* of the wheel passageway 74*c* is disposed in a position where it can eject the grinding water between the light applying means 9 and the grinding stones 74*a*.

Operation of the grinding apparatus 1 for grinding the wafer W shown in FIG. 3, operation of the grinding means 7 with the grinding wheel 74, and a method of machining the wafer W will be described below with reference to FIGS. 2, 3, and 5 through 9.

(1) Wafer Holding Step

Figure 6:
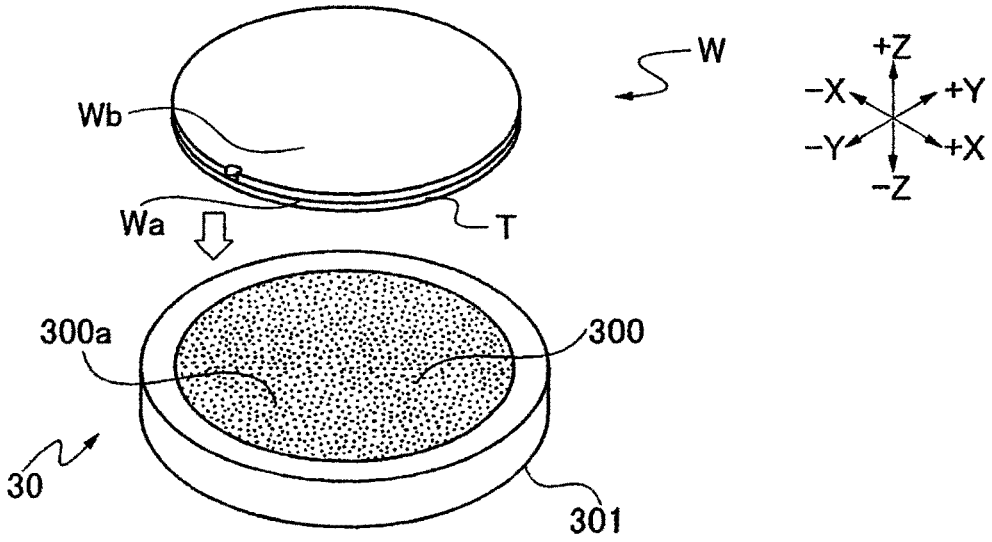
FIG. 6 is a perspective view showing the manner in which the wafer is held on a chuck table in a wafer holding step.

As shown in FIG. 5, a protective tape T for protecting the surface Wa of the wafer W when it is ground is applied to the surface Wa in its entirety. Then, as shown in FIG. 6, the side of the wafer W where the protective tape T is applied and the holding surface 300*a* of the chuck table 300 are brought to face each other and positioned with respect to each other, after which the wafer W is placed on the holding surface 300*a*. A suction force produced by the suction source, not shown, is transmitted to the holding surface 300*a*, so that the chuck table 30 holds the wafer W under suction on the holding surface 300*a*.

(2) Grinding Step

After the wafer holding step, a grinding step of grinding the wafer W held on the chuck table 30 in the wafer holding step is initiated. In the grinding step, the chuck table 30 is moved in a +Y direction from the loading/unloading area A shown in FIG. 3 to a position below the grinding means 7 in the grinding area B by the Y-axis feeder, not shown.

Figure 7:
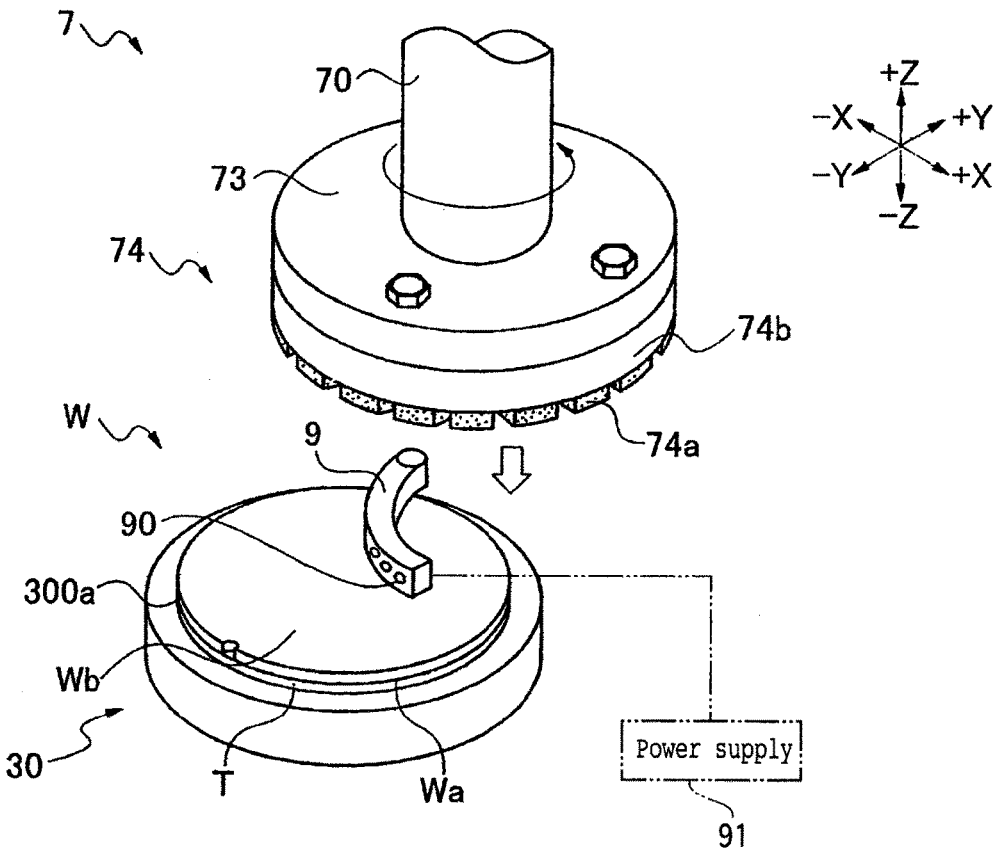
FIG. 7 is a perspective view showing the position of the light applying means at the time the grinding wheel is lowered toward the wafer held on the chuck table in a grinding step.
Figure 8:
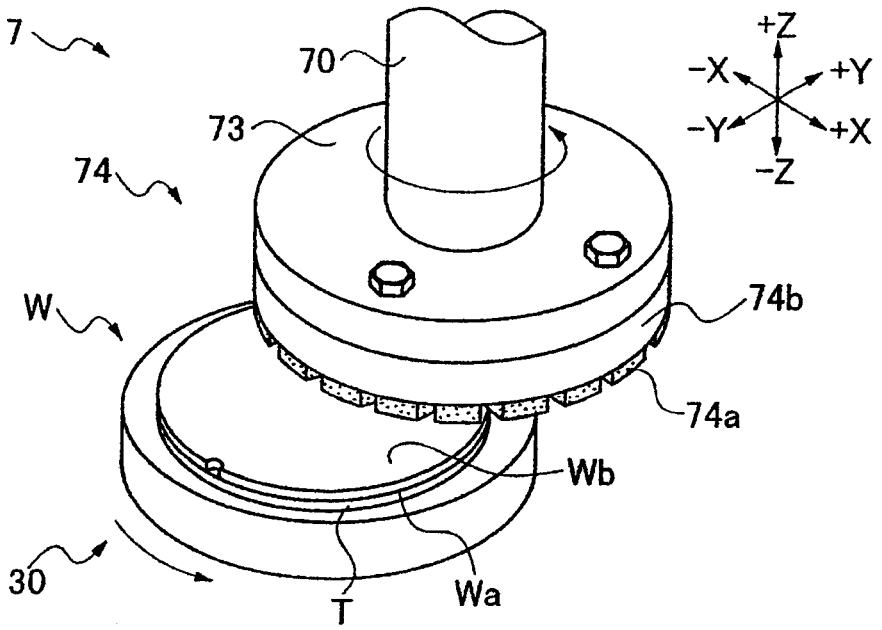
FIG. 8 is a perspective view showing the manner in which the grinding wheel is grinding the wafer held on the chuck table in the grinding step.

Then, as shown in FIG. 7, the spindle 70 is rotated about its own axis, rotating the grinding wheel 74 at a rotational speed of 6000 rpm, for example. At the same time, the grinding means 7 is fed in a −Z direction, lowering the grinding wheel 74 thereof in the −Z direction. The light applying means 9 is positioned so as to be disposed radially inwardly of the grinding stones 74*a* arranged annularly on the bottom surface of the wheel base 74*b* when the wafer W is ground, with the light emission ports 90 facing the inner circumferential surfaces of the grinding stones 74*a*. As shown in FIG. 8, the grinding stones 74*a* of the grinding wheel 74 which is rotated at a high speed are held in contact with the reverse side Wb of the wafer W, thereby grinding the wafer W. While the wafer W is being ground, the rotating means, not shown, rotates the chuck table 30 at a rotational speed of 300 rpm, for example. As the wafer W held on the holding surface 300*a* is also rotated, the grinding stones 74*a* grind the reverse side Wb of the wafer W in its entirety. In the grinding step, as shown in FIG. 9, when the grinding stores 74*a* contact the reverse side Wb of the wafer W, the grinding water that is supplied from the grinding water supply means 8 flows through the passageway 70*a* in the spindle 70, the mount passageway 73*b*, and the wheel passageway 74*c*, and is ejected from the opening 74*d* of the wheel passageway 74*c* so as to be supplied to the grinding stones 74*a* at a rate in the range from 5 L/minute to 10 L/minute.

In the grinding step, furthermore, as shown in FIG. 9, the light applying means 9 applies an ultraviolet radiation having a wavelength of about 365 nm to the grinding stones 74*a* of the grinding wheel 74 which is rotated at high speed, during at least a period of time from a time immediately before the grinding stones 74*a* start grinding the reverse side Wb of the wafer W until the grinding stones 74*a* become spaced from the wafer W, thereby exciting the titanium oxide particles P2 that are present in the grinding stones 74*a* shown in FIG. 2. In other words, the ultraviolet radiation is applied to the surfaces of the titanium oxide particles P2 in the grinding stones 74*a*, exciting the electrons in the valance band of the titanium oxide particles P2 to generate two types of carriers, i.e., electrons and holes.

The holes generated in the titanium oxide particles P2 that are present in the grinding stones 74*a* produce hydroxyl radicals that have high oxidizing power on the grinding water on the surfaces of the titanium oxide particles P2. Therefore, the grinding water supplied from the grinding water supply means 8 and brought into contact with the grinding stones 74*a* is given the oxidizing power from the hydroxyl radicals at least on the reverse side Wb of the wafer W. Since the reverse side Wb of the wafer W which is made of SiC is oxidized and embrittled by the generated hydroxyl radicals, it is possible to grind the wafer W easily with the grinding wheel 74. Inasmuch as the generated hydroxyl radicals are very short-lived, other parts than the reverse side Wb of the wafer W are not oxidized by the grinding water. The ejected grinding water is also effective to cool the region where the grinding stones 74*a* and the reverse side Wb of the wafer W are held in contact with each other and to remove debris produced from the ground reverse side Wb of the wafer W.

The present invention is not limited to the above embodiment, but various changes and modifications may be made in the embodiment. For example, even in the case where the wafer W is a wafer made of metal and the light applying means 9 is provided in the grinding apparatus 1 in integral combination with the grinding wheel 74, the wafer W is ground while the metal thereof is being oxidized and embrittled by the oxidizing power of hydroxyl radicals. Therefore, the wafer can smoothly be ground.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A method of grinding a wafer comprising the steps of:

holding a wafer on a chuck table;

grinding the wafer by pressing a plurality of grinding stones, disposed in an annular pattern on a bottom surface of a grinding wheel, each made of a mixture of abrasive grains and photocatalytic particles which are held together by a binder, against the wafer held on said chuck table and rotating said grinding stones and said chuck table while supplying grinding water to said grinding stones and said chuck table; and exciting the photocatalytic particles by applying light from a source disposed radially inward of said grinding stones, the light being applied to the grinding stones to give oxidizing power, based on hydroxyl radicals, to the supplied grinding water while the wafer is being ground.

* * * * *